US005803766A

United States Patent [19]

Yang

[11] Patent Number: 5,803,766

[45] Date of Patent: Sep. 8, 1998

[54] LAMP SOCKET

[76] Inventor: Henry W. H. Yang, No. 54-164, ShangLun Tzu, Shang Lun Tsun, Jenteh Hsiang, Tainan Hsien, Taiwan

[21] Appl. No.: 898,596

[22] Filed: Jul. 22, 1997

[51] Int. Cl.[6] ..... H01R 13/60

[52] U.S. Cl. ..... 439/567; 439/558; 439/573; 362/249

[58] Field of Search ..... 439/56, 57, 226, 439/234, 557, 558, 567, 573; 362/249, 250

[56] References Cited

U.S. PATENT DOCUMENTS 5,320,539 6/1994 Haskins ..... 439/558 X 5,380,208 1/1995 Ying ..... 439/558

5,544,031 8/1996 Blanton ..... 462/249 X

*Primary Examiner*—Khiem Nguyen

*Attorney, Agent, or Firm*—Bacon & Thomas

[57] ABSTRACT

A tubular lamp socket includes a body provided with two different selectable kinds of structures for fixing on a wall. One kind is using screws, and another is using engage arms. If a wall has an open hole, the engage arms can be used, and if otherwise, screws can be used. Thus it has convenience in fixing on a wall.

1 Claim, 5 Drawing Sheets

LAMP SOCKET

BACKGROUND OF THE INVENTION

This invention concerns a tubular lamp socket, particularly one possible to be set in two different modes selectable according to a wall condition, increasing practicability.

A tubular lamp socket is quite a common electric components easily usable. However, conventional tubular lamp socket is fixed in only one mode of using screws, and besides, once fixed, it is hard to be changed in its direction, with its practicability quite limited. For makers it makes very few profit as there are many kinds in competition, and for users it is not so convenient, having only one mode of fixing.

SUMMARY OF THE INVENTION

A purpose of the invention is to offer a tubular lamp socket possible to be fixed on a wall in two modes selectable according to a wall condition.

Another purpose of the invention is to offer a tubular lamp socket possible to change its direction in fixing on a wall.

The feature of the invention is two screw holes provided in a socket body, and two engage arms provided on two opposite sides so that the tubular lamp socket may be secured on a wall in two different selectable modes.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
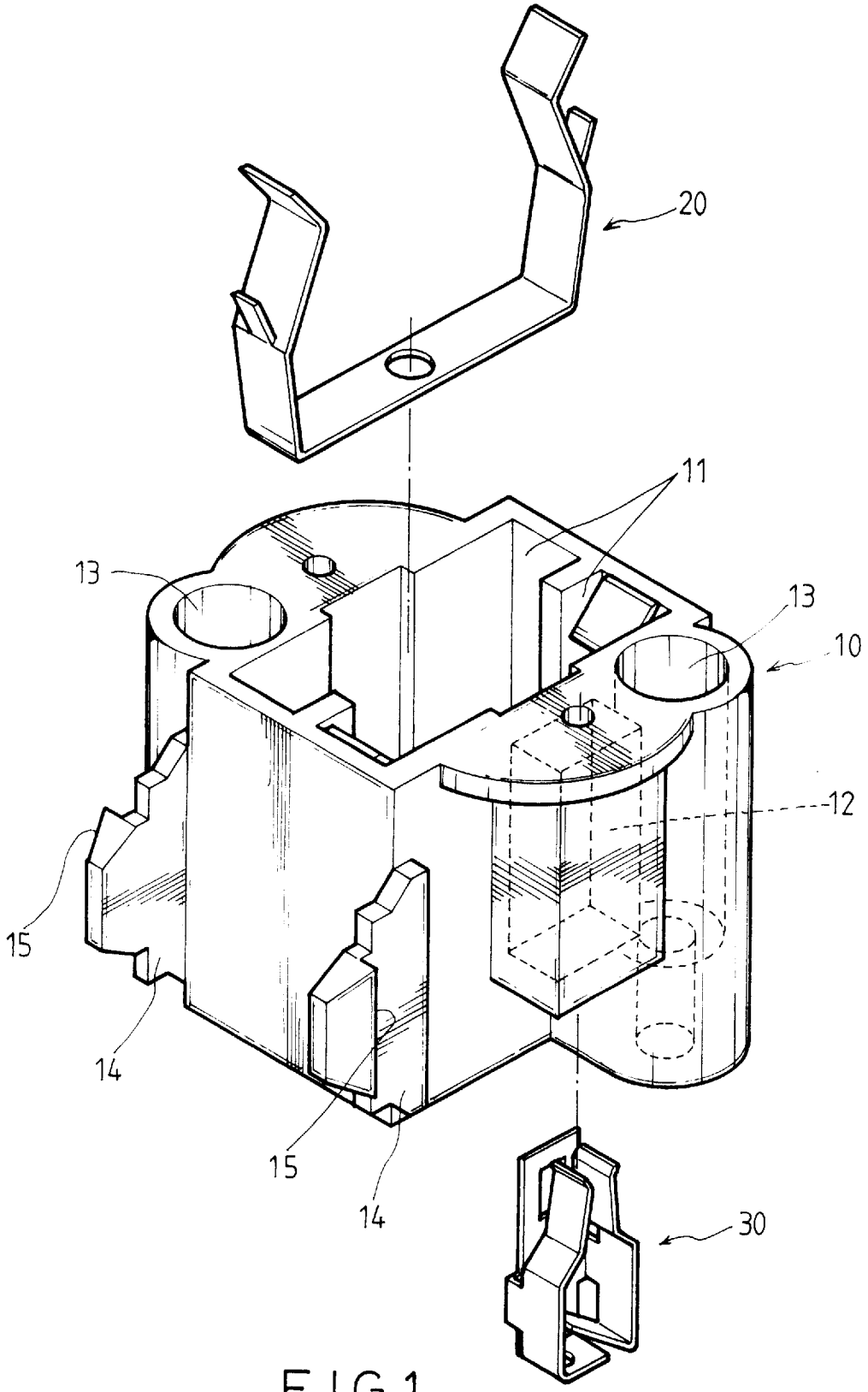
FIG. 1 is an exploded perspective view of a preferred embodiment of a lamp socket in the present invention.

A preferred embodiment of a tubular lamp socket in the present invention, as shown in FIG. 1, includes a body 10, two elastic metal clamps 20 fixed in the body 1 for clamping a tubular lamp 50 and not becoming brittle by high temperature, and two terminal 30 inserted in the body 10 for connecting a cord of power.

Figure 2:
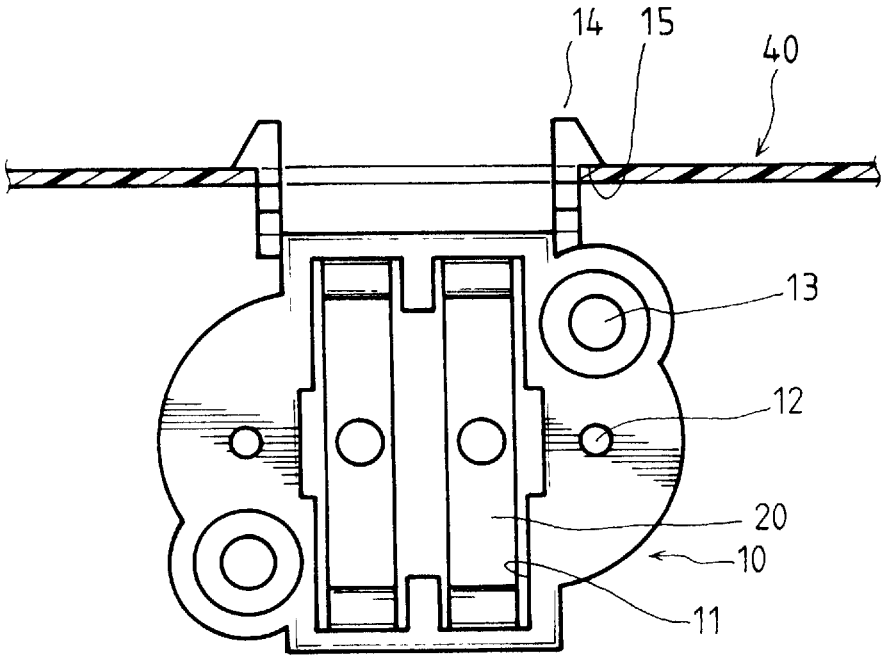
FIG. 2 is a front view of the preferred embodiment of a lamp socket in the present invention, secured by engage arms.
Figure 3:
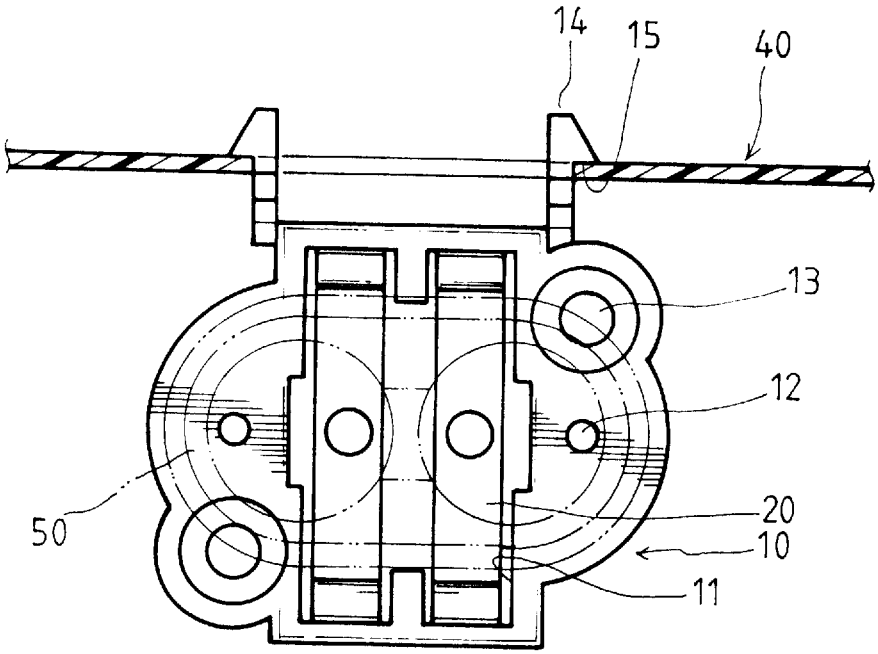
FIG. 3 is a front view of a lamp tube combine with the lamp socket in the present invention.
Figure 4:
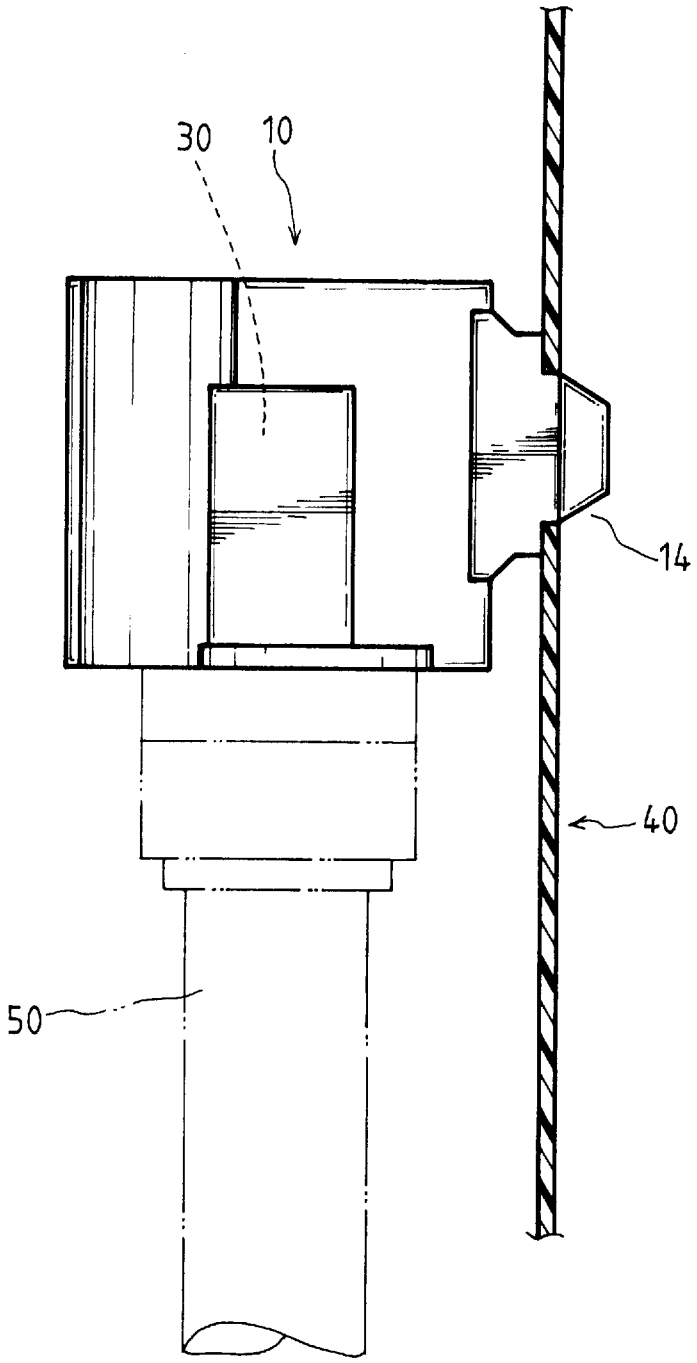
FIG. 4 is a side view of a lamp tube combined with the lamp socket in the present invention and secured with the engage arms; and, FIG. 5 is a side view of a lamp tube combined with the lamp socket in the present invention and secured with screws passing through screw holes.
Figure 5:
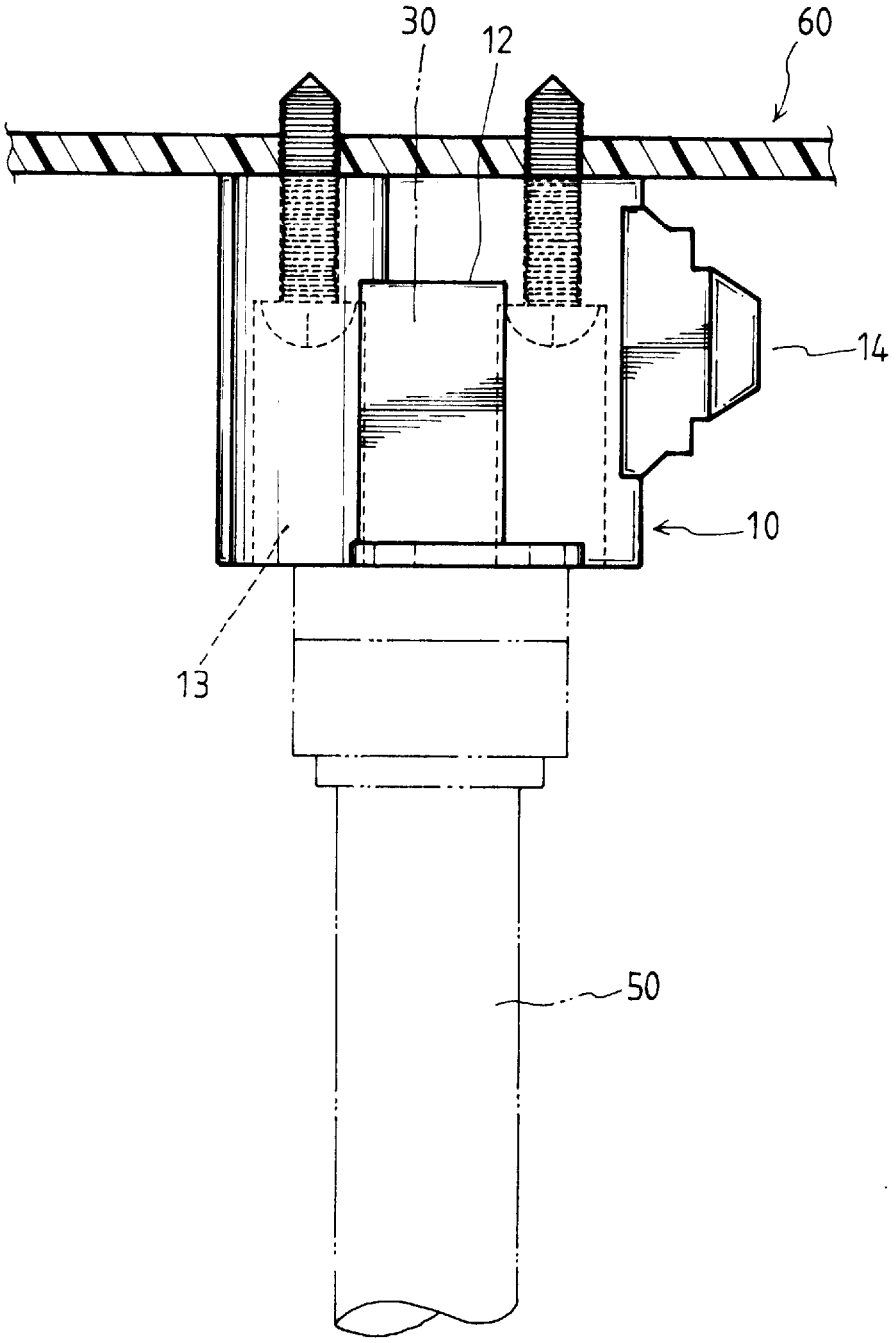

The body 10 has two parallel hollow chambers 11, 11 in an upper portion for the two elastic metal clamps 20, 20 to fit and secured therein. A wire connecting hole 12 is provided respectively at a right side and a left side of the two parallel chambers 11, 11 for the two terminals 30, 30 to be inserted therein. A feature of improved characteristics is a screw hole 13 formed beside each wire connecting hole 12 so that the body 10 may be secured by means of screws fitting through the screw holes 13, 13 to screw in a wall, as shown in FIG. 5. Further, an engage arm 14 is respectively provided on two opposite sides where the two wire connecting holes 12, 12 are located, projecting out of a side abutting the two opposite sides. Each engage arm 14 has a triangular projection formed in an outer end to form an engage face 15 aligned with each other. Then the body 10 may also be secured on a wall with the two engage arms 14, 14, as shown in FIGS. 2, 3 and 4.

The elastic metal clamp 20 and the terminals 30 are a well known art, needless to be described about their structure here.

As can be understood from the above description, the tubular lamp socket in the invention can be secured in two modes selectable. Provided a wall for the tubular lamp socket has a square hole, the body 10 of the tubular lamp socket may be quickly secured on the wall, by inserting the two elastic metal clamps 14, 14 in the hole, as shown in FIG. 2. In addition, in inserting process no tools are necessary, possible to be effected manually. Further, the tubular lamp socket can be altered for a tubular lamp to be oriented in a longitudinal or lateral direction, as shown in FIGS. 3 and 4. In case that there is no holes in a wall for the tubular lamp socket to be secured, it can also be secured by means of screws screwed through the screw holes 13, 13 into the wall, as shown in FIG. 5.

Therefore, the tubular lamp socket has convenience of two modes of setting on a wall to be selected, superior than conventional ones having only mode for setting. Besides, its producing cost may not be higher than that of conventional ones. Especially for users it is very simple to use.

While the preferred embodiment of the invention has been described above, it will be recognized and understand that various modifications may be made therein and the appended claims are intended to cover all such modifications which may fall within the spirit and scope of the invention.

I claim:

1. A tubular lamp socket comprising a body provided with a hollow chamber in an upper portion for an end of a tubular lamp to fit therein and wire connecting holes in a lower portion, two elastic metal clamps fitted in said hollow chamber for respectively clamping an end of a tubular lamp and not affected by high temperature, two terminals for connecting a cord of power inserted in said wire connecting holes, and characterized by a screw holes respectively provided beside said wire connecting holes for screws to insert through to fix said tubular lamp socket on a wall, and by an engage arm provided respectively on two opposite sides and protruding out of said two opposite sides, each said engage arm having a triangular outer end provided with a flat face, which may sit on a surface in a hole of a wall so that said tubular lamp socket may be secured on the wall, said body thus having two selectable modes for fixing.

* * * * *